US005217425A

United States Patent [19]

Cantrell

[11] Patent Number: 5,217,425

[45] Date of Patent: Jun. 8, 1993

[54] SPLIT-NIP SQUARING APPARATUS

[75] Inventor: Larry K. Cantrell, Spartanburg, S.C.

[73] Assignee: Grant Machinery, Inman, S.C.

[21] Appl. No.: 818,644

[22] Filed: Jan. 6, 1992

[51] Int. Cl.[5] ..... B31B 3/74; B31B 3/02

[52] U.S. Cl. ..... 493/465; 493/395; 493/178

[58] Field of Search ..... 493/123, 124, 125, 126, 493/127, 142, 178, 179, 395, 465

[56] References Cited

U.S. PATENT DOCUMENTS 3,030,867 4/1962 Wright ..... 493/142
3,085,480 4/1963 Kauffman et al. .
3,744,649 7/1973 Ward .
3,850,085 11/1974 Klemm .
3,992,982 11/1976 Huiskes .
4,041,849 8/1977 Tsukasaki .
4,254,692 3/1981 Sardella .
4,438,917 3/1984 Janssen et al. .
4,511,242 4/1985 Ashbee et al. .
4,657,236 4/1987 Hirakawa et al. .
4,839,674 6/1989 Hanagata et al. .
4,855,607 8/1989 Eckl .
4,955,964 9/1990 Hain .
4,971,304 11/1990 Lofthus .
4,976,672 12/1990 Harrison et al. .

*Primary Examiner*—William E. Terrell
*Attorney, Agent, or Firm*—Price, Heneveld, Cooper, DeWitt & Litton

[57] ABSTRACT

An apparatus for squaring folded corrugated paperboard boxes and the like includes a frame, an upper drive assembly and a lower roll assembly. The upper drive assembly and lower roll assembly define a split-nip. The upper drive assembly includes a pair of independent wheels which may be controlled to adjust or change the orientation of a folded corrugated box passing through the nip. The upper drive assembly is pivoted to the frame for adjustment of the nip. The apparatus is positioned to deliver folded corrugated boxes to a counter/ejector from a folder/gluer.

17 Claims, 2 Drawing Sheets

SPLIT-NIP SQUARING APPARATUS

BACKGROUND OF THE INVENTION

The present invention relates to a box making apparatus and more particularly to a unique device for squaring folded boxes of corrugated material.

Various types of equipment are used to manufacture corrugated paperboard boxes or cartons. The equipment includes printers, rotary die cutters used for slotting and scoring and folder/gluers. Typically, blanks of corrugated paperboard are slotted and score lines are formed. The paperboard blanks are then passed into a folder/gluer. The folder/gluer generally employs bars, belts or rollers to progressively fold the blank and apply glue to form a folded box or container having the shape of a flattened parallelogram. The folded blanks are then transported to a counter/ejector or accumulator device. The blanks are stacked, counted and ejected in bundles. Examples of such equipment may be found in U.S. Pat. No. 3,850,085 entitled METHOD AND APPARATUS FOR FABRICATING AN ELONGATED CARTON, which issued on Nov. 26, 1974 to Clemm; U.S. Pat. No. 3,992,982 entitled FOLDING APPARATUS FOR CORRUGATED PAPERBOARD BLANKS, which issued on Nov. 23, 1976 to Huiskes; U.S. Pat. No. 4,041,849 entitled APPARATUS FOR FOLDING CARTON SHEET, which issued on Aug. 16, 1977 to Tsukasaki; and U.S. Pat. No. 4,254,692 entitled HELICAL FOLDER FOR PAPERBOARD BLANKS, which issued on Mar. 10, 1989.

The flat folded boxes are often out-of-square when they leave the folder/gluer. Inherent design and operational problems, such as belt slippage and drag on the folding bars, will produce a folded box wherein the flaps fold in a skewed or out-of-square manner. The stacks of folded boxes can be subjected to an edge beating or "spanking" action in the counter/ejector or other accumulator to correct the out-of-square condition. Spanking the folded boxes while the glue is still wet will square the folded container blanks in the stack. A spanker mechanism, however, generally works only if the boxes are slightly skewed.

Heretofore, it has been proposed to use twisted belts driven by variable speed motors in an attempt to correct skewness and slot gap error. The twisted belts are typically mounted close to the folding crease of the boxes. Consequently, the belts have a limited mechanical advantage for correcting skewness in gap area. Such an arrangement has only limited utility. The box flaps, upon leaving the folding section and entering the counter/ejector, are immediately caught in the nip of the feed rollers of the counter/ejector. The rollers prevent the box flaps from shifting since they have greater gripping strength than the twisted belts. The rollers, therefore, negate the effort of the twisted belts to make any correction in the out-of-square condition. A conflict, therefore, exists between the powered, variable speed twisted belts at the end of the folding section of the apparatus and the fixed speed rollers at the entrance of the counter/ejector.

Examples of prior devices which address the out-of-square condition may be found in U.S. Pat. No. 3,744,649 entitled SQUARING AND BUNDLE COUNTING MACHINE, which issued on Jul. 10, 1973 to Ward, Jr. and U.S. Pat. No. 4,976,672 entitled SQUARING FOLDED CONTAINER BLANKS, which issued on Dec. 11, 1990 to Harrison et al.

SUMMARY OF THE INVENTION

In accordance with the present invention, the aforementioned problems with squaring of folded corrugated paperboard blanks or boxes are substantially eliminated. Essentially, an apparatus is provided which includes an upper drive assembly and a lower roll assembly which define a nip therebetween. The upper drive assembly includes a pair of independently controlled or driven upper wheels or rolls. The independently controlled upper wheels eliminate the aforementioned conflict between powered belts at the end of a folding section and fixed speed rollers at the entrance to the counter/ejector by allowing either wheel to advance or retard the flap which it is controlling. The operator of the equipment may, by observing the gap between the flaps of the folded corrugated blank, make the necessary adjustments to the relative speed of the upper split-nip wheels to square the folded box.

In narrower aspects of the invention, the split-nip wheels are horizontally adjustable. The wheels can be mounted near the glue joint of the folded corrugated box to provide the maximum possible mechanical advantage for squaring the box. In addition, a pair of free wheeling pull-down wheels may be included. Further, the lower nip roll may be an elongated roller mounted independently of the upper drive assembly. The lower nip roll is powered in relationship to the speed of the folding belts of the folder/gluer, which feeds the folded boxes to the apparatus. In addition, provision is made for adjusting the nip or gap between the upper drive assembly and the lower roll assembly to accommodate the thickness of the folded box and to provide sufficient pressure to advance or retard the individual box flaps as required.

DETAILED DESCRIPTION OF THE PREFERRED EMBODIMENT

Figure 1:
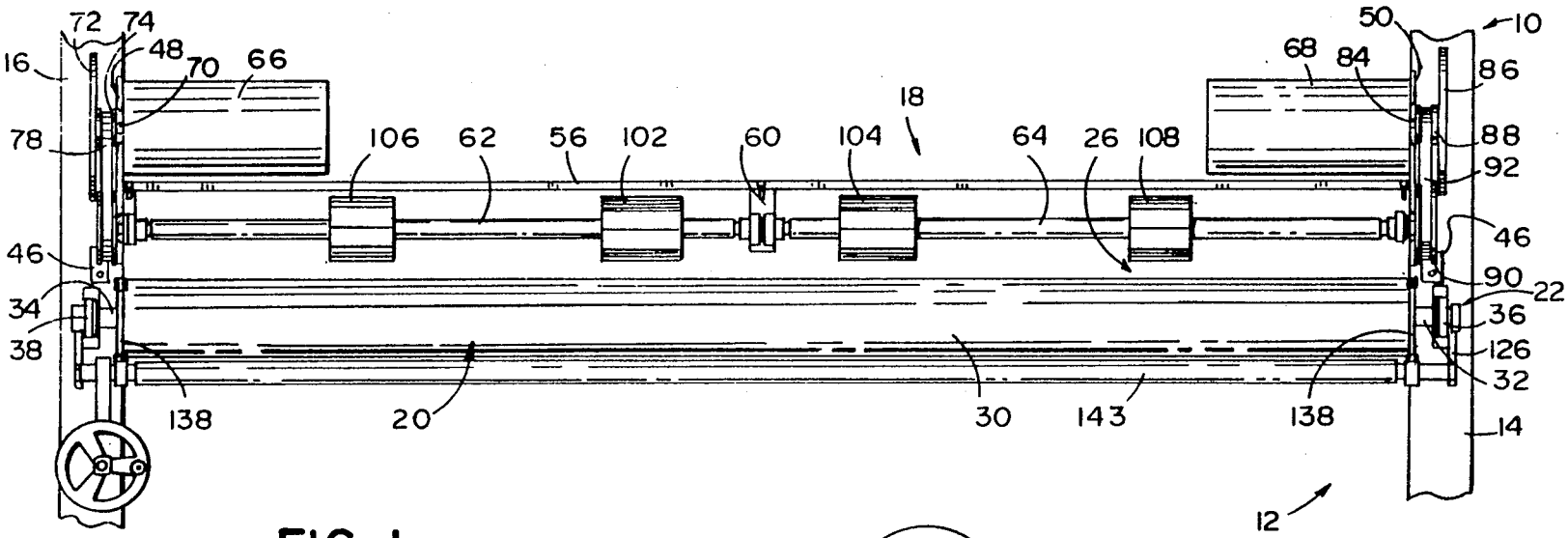
FIG. 1 is a fragmentary, front elevational view of an apparatus in accordance with the present invention.

A preferred embodiment of a squaring apparatus in accordance with the present invention is illustrated in the drawings and generally designated by the numeral 10. Device 10 includes a frame 12 having vertical uprights or side members 14, 16. Device 10 further includes an upper drive subassembly 18, a lower roll subassembly 20 and an adjustment mechanism 22. Upper roll assembly 18 and lower roll assembly 20 define a nip 26. Frame 12 is positioned at the exit or output end of a folder/gluer and at the entrance to a counter/ejector. Folded corrugated board boxes 28 are delivered to the nip 26 along a longitudinal axis 29 of the box making equipment. Apparatus 18 transports corrugated board to the counter/ejector.

Lower roll assembly 20 includes an elongated roller 30. Roller 30 includes end shafts 32, 34 supported in bearings 36, 38, respectively. Bearings 36, 38 are supported on mounting plates 42. Plates 42 are secured to frame members 14, 16. Roller 20 is, therefore, rotatably supported on the frame. The roller is powered in relationship to the speed of the folding belts of the folder/-gluer. The lower roll drive may be a mechanical interconnection with the folder/gluer, such as a pulley and belt arrangement, or an electrical interconnection may be used. It is preferred that the lower roll be driven by a variable speed drive motor and that the relationship be achieved electrically. The drive is schematically shown in FIG. 1 and designated by the numeral 45. It is presently preferred that the surface speed of roller 30 have substantially a one-to-one relationship to the speed of the folding belts.

Upper drive assembly 18 includes mounting brackets 46 secured to frame uprights 14, 16. Side mounting plates 48, 50 are pivoted to a respective mounting bracket 46 by a pivot pin 54. An elongated cross member 56 extends between plates 48, 50. A bearing support block or mounting plate 60 is secured to cross member 56 intermediate the ends thereof and generally intermediate or centrally of plates 48, 50. A first shaft 62 extends between plate 48 and block 60. A second shaft 64 extends between block 60 and plate 50. Shafts 62, 64 are rotatably mounted by suitable bearings at their ends at the plates 48, 50 and the block 60, respectively.

A first drive motor 66 is mounted on plate 48. A second drive motor 68 is mounted on plate 50. Motor 66 includes an output shaft 70 to which a fly wheel 72 and a drive gear or pulley 74 are mounted. Output shaft 70 is connected to shaft 62 by a flexible drive transmission member, gear belt or chain 78. Flexible drive transmission member 78 extends between shaft 70 and a gear, pulley or sprocket 80 nonrotatably fixed to an end of shaft 62. In the same fashion, motor 68 includes an output shaft 84. A fly wheel 86 is also mounted on the end of shaft 84. Pulleys, gears or sprockets 88, 90 and a flexible drive transmission member 92 interconnect output shaft 84 with shaft 64. It is currently preferred that gear belt drives connect the motor to the shafts.

A pair of driven rollers or upper nip wheels 102, 104 are nonrotatably positioned on shafts 62, 64, respectively. Wheels 102, 104 may be adjusted horizontally or towards and away from mounting plates 48, 50. Also supported on shafts 62, 64 are a pair of free wheeling hold-down wheels 106, 108. Wheels 102, 104 divide or split nip 26 into two independent sections.

The size of nip 26 is adjusted through mechanism 22. As shown in the drawings, the mechanism 22 includes mounting plates or brackets 120 and a bellcrank arrangement 122. Arrangement 122 includes first and second arms 124, 126. The angular relationship between arms 124, 126 is fixed, and the arms are pivoted to support brackets or plates 120 by a pivot pin 128. A shaft 130 is threaded through an aperture in arm 126. A hand wheel or ratchet 132 is fixed to the shaft. Rotation of hand wheel or ratchet 132 with the shaft 130 in engagement with a side frame member 14, 16 shifts the position of arm 126. Arm 126, which supports adjustment wheel 132, is connected to arm 126 at upright 14 by an elongated linkage shaft 143. As a result, a change in the position of arm 126 is translated to a change in the position of both plates 48, 50. Arms 124 are connected to mounting plates 48, 50 by adjustable links 138.

Figure 2:
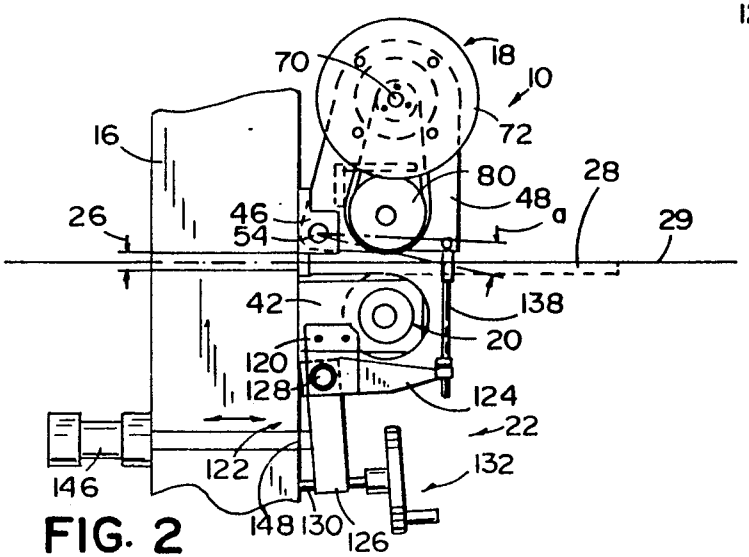
FIG. 2 is a left side elevational view of the apparatus of FIG. 1.

Rotation of hand wheel or ratchet 132 moves plates 48, 50 and, hence, wheels 102, 104 through an angle "a" (FIG. 2). It is currently preferred that angle "a" be a maximum of at least 10 degrees. Wheels 102, 104 may be moved towards and away from roll 30 to adjust the nip or spacing therebetween to accommodate the folded corrugated boxes.

A piston/cylinder actuator 146 is mounted on frame member 16. Actuator 146 includes a rod 148 connected to arm 126. Actuator 146 permits rapid opening of nip 26 if a folded box jams between the upper and lower assemblies 18, 20.

Figure 3B:
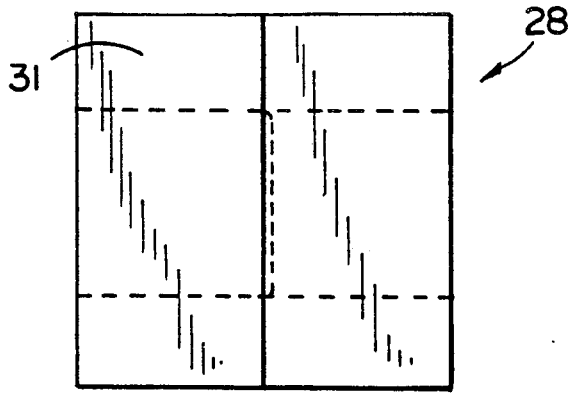
FIG. 3B is a top view schematically illustrating a squared, corrugated box.
Figure 3A:
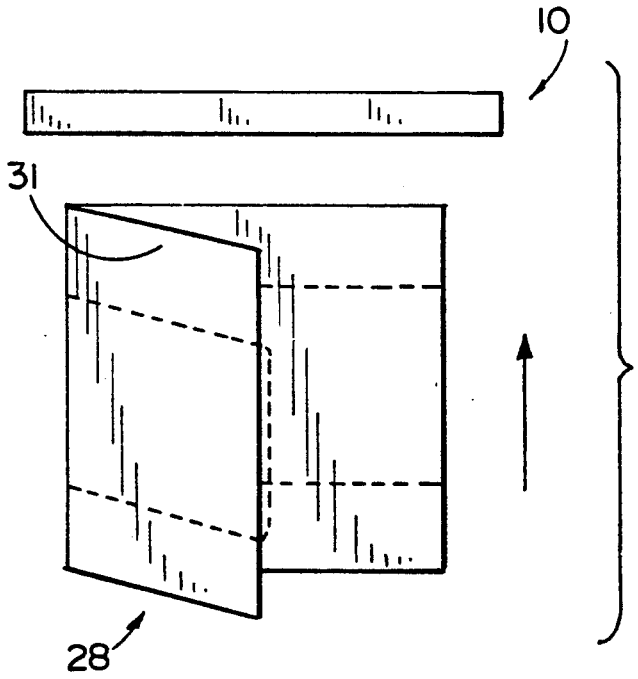
FIG. 3A is a top view schematically illustrating a skewed, corrugated box

In use, a folded, corrugated box 28 is delivered to the split nip 26 between driven wheels 102, 104, freely rotating wheels 106, 108 and the lower roll 30. Wheels 102, 104 are independently controlled or driven by their own DC or other variable speed motors 66, 68. The operator, by observing the gap or skewness condition of the folded corrugated box, can adjust the speed of the motors 66, 68 to advance or retard the flap which is controlled by and engaged by the respective wheels 102, 104. In the alternative, an automatic gap sensing device could be used to sense skewness and control the drive motors to correct gap error automatically. A skewed box 28 with an out-of-square flap 31 before entering apparatus 10 in accordance with the present invention is illustrated in FIG. 3A. FIG. 3B illustrates a squared box after passing through apparatus 10.

Wheels 102, 104 may be moved horizontally so that they are near the ends of the flaps and, hence, towards the gap of the folded corrugated box. The maximum possible mechanical advantage for squaring the box may, therefore, be obtained. The adjustment of the nip, the positioning of the driven wheel and use of the hold-down wheels ensure that sufficient pressure is provided to advance or retard the individual flaps as required. The subject split-nip squaring device eliminates the conflict heretofore experienced between powered, variable speed twisted belts at the end of the folding section and fixed speed nip rollers at the entrance of the counter/ejector.

In view of the foregoing description, those of ordinary skill in the art may envision various modifications to the present invention which would not depart from the inventive concepts disclosed herein. For example, the individual DC motors could be replaced with a single drive motor and variable speed pulleys. In the alternative, variable speed pulleys could be driven off a powered roll of the box making equipment. The lower roll assembly could be a belt as opposed to the elongated roller illustrated. The above description should, therefore, be considered as only that of the preferred embodiment. The true spirit and scope of the present invention may be determined by reference to the appended claims.

The embodiments of the invention in which an exclusive property or privilege is claimed are defined as follows:

1. An apparatus for squaring folded corrugated boxes, said apparatus comprising:

a frame;

an upper drive assembly including a pair of axially aligned drive members and a pair of drive motors, each motor connected to one of said drive members so that said drive members may be independently driven;

a lower roll assembly rotatably mounted on said frame independent of said upper drive assembly, said lower roll assembly being spaced from said upper drive assembly a fixed space thereby defining a nip with said upper drive assembly; and adjustment means operatively connected to one of said upper drive assembly and said lower roll assembly for adjustably positioning said assemblies to permit adjustment of the fixed space between said assemblies to adjust the size of said nip.

2. An apparatus as defined by claim 1 wherein said upper drive assembly is pivoted to said frame and said adjustment means is connected to said upper drive assembly.

3. An apparatus as defined by claim 2 wherein said lower roll assembly comprises an elongated roller having ends rotatably mounted on said frame.

4. An apparatus as defined by claim 1 wherein said upper drive assembly further includes a pair of side plates pivoted to said frame, a cross member extending between said plates and a pair of axially aligned shafts rotatably supported by said side plates and said cross member, said drive members being fixed to said shafts.

5. An apparatus as defined by claim 4 wherein said upper drive assembly further includes a pair of hold-down members rotatably mounted on said shafts, said hold-down members rotating freely and independently of said drive members.

6. An apparatus for squaring folded corrugated boxes, said apparatus comprising:

a frame;

an upper drive assembly including a pair of axially aligned drive members and a pair of drive motors, each motor connected to one of said drive members so that said drive members may be independently driven;

a lower roll assembly rotatably mounted on said frame independent of said upper drive assembly and defining a nip with said upper drive assembly; and adjustment means operatively connected to one of said upper drive assembly and said lower roll assembly for adjustably positioning said assemblies to permit adjustment of the size of said nip, said upper drive assembly being pivoted to said frame and said adjustment means being connected to said upper drive assembly, and wherein said adjustment means comprises:

a mounting plate fixed to said frame;

a bellcrank pivoted to said mounting plate, said bellcrank including first and second arms;

a link extending from said first arm to said upper drive assembly; and manually movable means between the bellcrank and said frame for adjusting the position of said bellcrank with respect to said frame.

7. An apparats as defined by claim 6 further including a piston/cylinder actuator on said frame and having a piston rod connected to said bellcrank.

8. An apparatus for squaring folded corrugated boxes, said apparatus comprising:

a frame;

an upper drive assembly including a pair of axially aligned drive members and a pair of drive motors, each motor connected to one of said drive members so that said drive members may be independently driven;

a lower roll assembly rotatably mounted on said frame independent of said upper drive assembly and defining a nip with said upper drive assembly; and adjustment means operatively connected to one of said upper drive assembly and said lower roll assembly for adjustably positioning said assemblies to permit adjustment of the size of said nip, said upper drive assembly being pivoted to said frame and said adjustment means being connected to said upper drive assembly, said lower roll assembly comprising an elongated roller having ends rotatably mounted on said frame, and wherein said upper drive assembly further includes a pair of side plates pivoted to said frame, a cross member extending between said plates and a pair of axially aligned shafts rotatably supported from said side plates and said cross member, said drive wheels being fixed to said shafts.

9. An apparatus as defined by claim 8 wherein said adjustment means comprises:

a mounting plate fixed to said frame;

a bellcrank pivoted to said mounting plate, said bellcrank including first and second arms;

a link extending from said first arm to said upper drive assembly; and manually movable means between the bellcrank and said frame for adjusting the position of said bellcrank with respect to said frame.

10. An apparatus as defined by claim 9 wherein said upper drive assembly further includes a pair of hold-down wheels rotatably mounted on said shafts, said hold-down wheels rotating freely and independently of said drive members.

11. An apparatus as defined by claim 10 further including a piston/cylinder actuator on said frame and having a piston rod connected to said bellcrank.

12. A squaring device for changing the orientation of a folded corrugated sheet moving from a folder/gluer to a counter/ejector in a box making apparatus, said device comprising:

a lower roll assembly;

an upper drive assembly positioned and spaced above said lower roll assembly and thereby defining a fixed nip therewith, said upper drive assembly including a pair of axially aligned and independently driven drive means for engaging a corrugated sheet disposed within said nip and changing the orientation of the sheet with respect to a longitudinal axis of the box making apparatus;

adjustment means operatively connected to said upper drive assembly for moving said upper drive assembly to change the spacing with said lower roll assembly and thereby adjusting the size of said fixed nip, each of said drive means comprising:

an elongated shaft;

a drive motor connected to said shaft; and a drive wheel fixed to said shaft for rotation therewith, said drive wheel being horizontally adjustable along said shaft; and at least one hold-down wheel rotatably mounted on each of said shafts in axially spaced relationship with said drive wheels.

13. A squaring device as defined by claim 12 wherein said adjustment means comprises:

a frame, said upper drive assembly being pivoted to said frame;

a pair of adjustment arms pivoted to said frame and connected to said upper drive assembly; and means connected to said arms for pivoting said arms with respect to said frame.

14. A squaring device as defined by claim 12 wherein said lower roll assembly comprises an elongated roller having ends rotatably mounted on said frame.

15. A squaring device as defined by claim 14 wherein said hold-down wheels are horizontally adjustable on said shafts.

16. A squaring device for changing the orientation of a folded corrugated sheet moving from a folder/gluer to a counter/ejector in a box making apparatus, said device comprising:

a lower roll assembly;

an upper drive assembly positioned above said lower roll assembly and defining a nip therewith, said upper drive assembly including a pair of axially aligned and independently driven drive means for engaging a corrugated sheet disposed within said nip and changing the orientation of the sheet with respect to a longitudinal axis of the box making apparatus;

adjustment means operatively connected to said upper drive assembly for moving said upper drive assembly and adjusting said nip, each of said drive means comprising:

an elongated shaft;

a drive motor connected to said shaft; and a drive wheel fixed to said shaft for rotation therewith, said drive wheel being horizontally adjustable along said shaft; and at least one hold-down wheel rotatably mounted o each of said shafts in axially spaced relationship with said drive wheels, said adjustment means comprising:

a frame, said upper drive assembly being pivoted to said frame a pair of adjustment arms pivoted to said frame and connected to said upper drive assembly; and means connected to said arms for pivoting said arms with respect to said frame, and wherein said drive means further includes:

a pair of mounting plates pivoted to said frame, each of said drive motors being mounted on one of said plates;

a cross member extending between said plates; and a bearing support positioned intermediate ends of said cross member, said shafts having ends rotatably mounted on one of said plates and said bearing support.

17. A squaring device for changing the orientation of a folded corrugated sheet moving from a folder/gluer to a counter/ejector in a box making apparatus, said device comprising:

a lower roll assembly;

an upper drive assembly positioned above said lower roll assembly and defining a nip therewith, said upper drive assembly including a pair of axially aligned and independently driven drive means for engaging a corrugated sheet disposed within said nip and changing the orientation of the sheet with respect to a longitudinal axis of the box making apparatus; and adjustment means operatively connected to said upper drive assembly for moving said upper drive assembly and adjusting said nip, said lower roll assembly comprising an elongated roller having ends rotatably mounted on said frame;

said drive means each comprising;

an elongated shaft;

a drive motor connected to said shaft; and a drive wheel fixed to said shaft for rotation therewith; and at least one hold-down wheel rotatably mounted o each of said shafts in axially spaced relationship with said drive wheels, said hold-down wheels being horizontally adjustable on said shafts, and wherein said drive means further includes:

a pair of mounting plates pivoted to said frame, each of said drive motors being mounted on one of said plates;

a cross member extending between said plates; and a bearing support positioned intermediate ends of said cross member, said shafts having ends rotatably mounted on one of said plates and said bearing support.

* * * * *